US005353484A

United States Patent [19]

Woedl et al.

[11] Patent Number: 5,353,484

[45] Date of Patent: Oct. 11, 1994

[54] CASKET, CASKET PRECURSOR, AND METHOD OF MAKING SAME

[75] Inventors: Stephen D. Woedl, Oxford, Ohio; John D. Soroka, Rochester Hills, Mich.; Gerald H. Davis, Lynn, Ind.

[73] Assignee: Elder-Davis, Inc., Richmond, Ind.

[21] Appl. No.: 33,203

[22] Filed: Mar. 16, 1993

[51] Int. Cl.[5] ..... A61G 17/00

[52] U.S. Cl. ..... 27/4; 27/19; 27/35

[58] Field of Search ..... 27/2, 4, 19, 35; 229/166, 23 C

[56] References Cited

U.S. PATENT DOCUMENTS

| | | | |
|---|---|---|---|
| 1,003,510 | 9/1911 | Reber | 229/166 |
| 2,711,280 | 6/1955 | Richardson | 229/23 C |
| 4,209,880 | 7/1980 | Lidholm | 27/2 |
| 4,730,370 | 3/1988 | Elder | 27/4 |
| 4,773,134 | 9/1988 | Kay | 27/14 |
| 4,800,631 | 1/1989 | Pellmann | 27/7 |
| 4,854,018 | 8/1989 | VonBratt | 27/19 |
| 4,944,076 | 7/1990 | Kay et al. | 27/14 |
| 4,967,455 | 11/1990 | Elder | 27/4 |
| 5,092,020 | 3/1992 | MaGuire | 27/19 |
| 5,111,559 | 5/1992 | Mohr et al. | 27/4 |

FOREIGN PATENT DOCUMENTS

| | | | |
|---|---|---|---|
| 2590796 | 6/1987 | France | 27/19 |

OTHER PUBLICATIONS

Advertising Material by Timbalyte U.S.A., Inc. 5 pages (Prior to Fall of 1992).

*Primary Examiner*—Carl D. Friedman
*Assistant Examiner*—Kien Nguyen
*Attorney, Agent, or Firm*—Synnestvedt & Lechner

[57] ABSTRACT

A casket is made by covering one side of a flat precursor blank of corrugated fiberboard with a liquid-impervious flexible liner and the other side with a pliable decorative cloth, shipping the thus-covered blank to a point of use, and then folding it up into a complete lined and covered casket. Appropriate foldable flaps are provided at the ends of the precursor, and framing strips are secured along the sides of the blank for support prior to folding-up of the casket precursor to form the casket. The end flaps are held in their folded-up positions by manually insertable fasteners, and the hinges for the lid of the casket are secured by hand-stapling to the tops of the framing members. The triangular folds formed in the liner at its corners when it is fold up are tucked between the end flaps as they are being folded. The entire casket body can be shipped as a flat blank, and easily assembled manually at a remote location by unskilled persons.

17 Claims, 5 Drawing Sheets

Fig. 8.
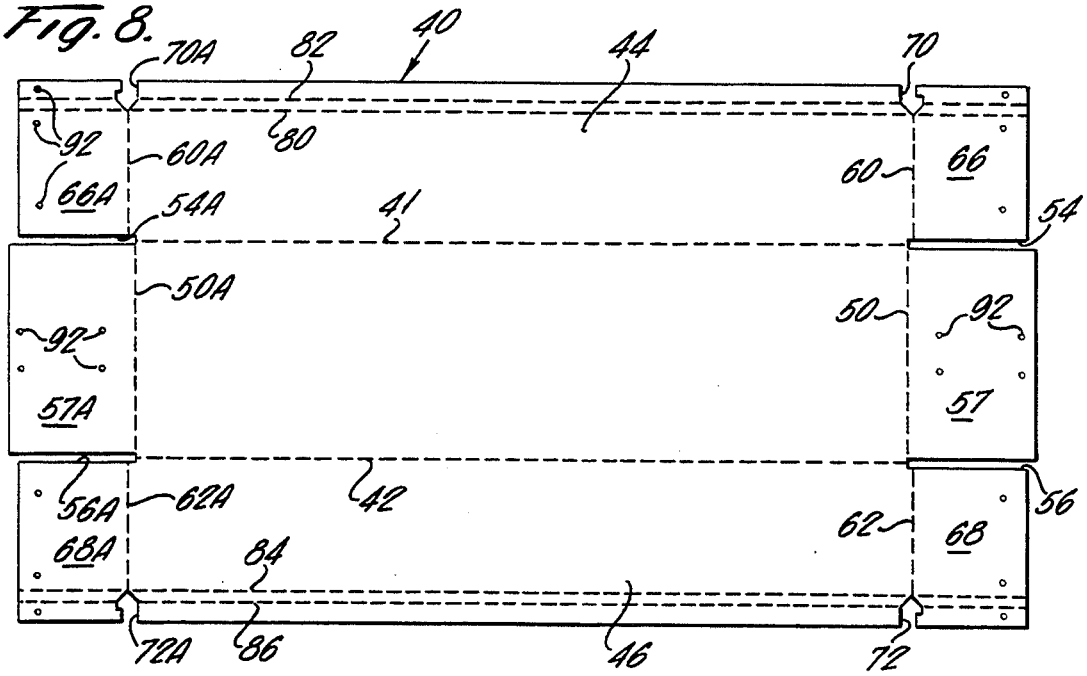
Fig. 9.
Fig. 10.
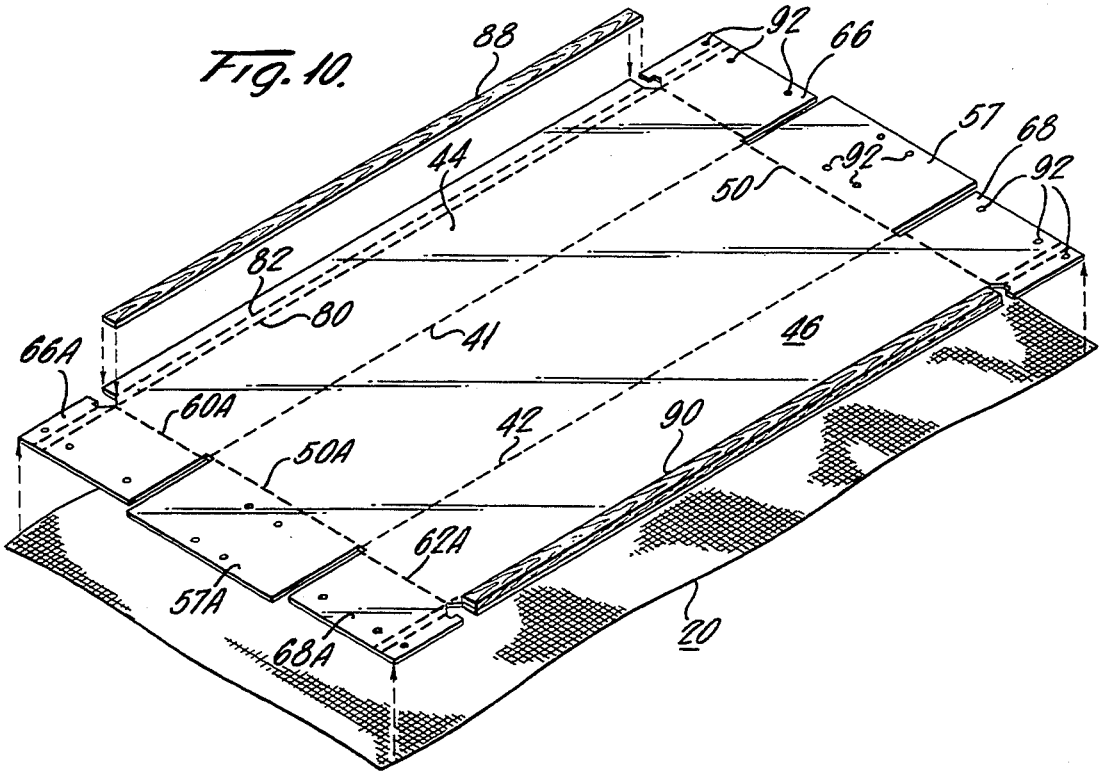

CASKET, CASKET PRECURSOR, AND METHOD OF MAKING SAME

FIELD OF THE INVENTION

This invention relates to caskets, casket precursors from which they can be made, and to methods of making same. It relates especially to caskets of the type which can be made by folding up a flat precursor blank of corrugated fiberboard into a box-like casket body for receiving the remains of a deceased human.

BACKGROUND OF THE INVENTION

It is known to make caskets for the final disposal of human remains by scoring and cutting a flat blank of corrugated fiberboard and then folding it up to form a casket body for receiving the corpse. Such caskets and methods for making them are disclosed, for example, in U.S Pat. No. 4,967,445, issued Nov. 6, 1990 and U.S. Pat. No. 4,773,134, issued Sep. 27, 1988. The casket body is preferably covered interiorly with a liquid-impervious liner, and its exterior provided with a decorative covering.

Such caskets require substantial finishing work after the precursor blank has been folded up into casket form, to install the interior lining and the exterior covering. This constitutes a substantial and commercially important drawback, especially in certain situations. For example, it is often desirable to be able to ship the flat precursor blank to a remote point of use, which may be in a foreign country, where unskilled persons can take the blank and convert it into a completed casket body. According to the prior art, one must either ship and store the casket in final assembled form, which because of its substantial volume is very costly and inconvenient, or provide skilled workmen at the point of use to apply the liner and decorative covering, which is also expensive and inconvenient.

A principal object of the present invention is to provide a casket, casket precursor and method for converting the precursor into a casket, which permit shipment and storage of the precursor as a flat blank, and permit easy, quick conversion of the precursor blank into a casket body with liner and exterior covering, without requiring skilled labor or expensive tools.

SUMMARY OF THE INVENTION

In accordance with the invention, a precursor blank for a casket body is provided which has a decorative covering on at least one face thereof such that, when the blank is folded up into a casket body, the covering extends over the exterior of the casket body and is wrapped around all of the edges that may be viewed after assembly of the casket body as desired. Preferably, the other face of the flat precursor blank is provided with a liner fabric such that when the blank is folded up to form the casket body, the interior of the body is covered with the liner.

Accordingly, the precursor blank can be made at a manufacturing site and shipped flat, as a blank, to the point of use, where an unskilled person need merely fold it up into the shape of a casket body and maintain it in that shape by manual insertion of fasteners extending through folded-up end flaps at each end of the casket body.

In the preferred embodiment the blank is provided with rigid framing members, which may be of wood, extending along its longitudinal side edges and secured thereto; the liner is preferably of a generally rectangular shape such that a triangular double fold of liner fabric is formed at each corner when the casket is folded up, these double-folds being tucked between the end flaps before securing them to each other, to assure that there can be no leakage from the liner at its corners. Further, in the preferred embodiment the fasteners used at each end of the casket to hold it in assembled position are manually applicable, so that no tools are needed to install them.

Accordingly, a complete casket body having a decorative covering and liquid-impervious liner may be formed readily, rapidly and easily, at the point of use by an unskilled person, and without the need for special tools.

BRIEF DESCRIPTION OF THE DRAWINGS

These and other objects and features of the invention will be more readily understood from a consideration of the following detailed description, taken with the accompanying drawings, in which:

FIG. 8 is a plan view of a corrugated fiberboard blank, appropriately scored and cut which, after application of the side framing members, its decorative outer covering and its inner liner, is shipped to a point of use where it is folded up into a casket body;

FIG. 9 is a side elevational view of the blank of FIG. 8;

FIG. 10 is an isometric view showing the blank with one side framing member applied and the other about to be applied, and with the decorative covering aligned beneath it, preparatory to adhering it to the blank;

DETAILED DESCRIPTION OF PREFERRED EMBODIMENTS

Figure 2:
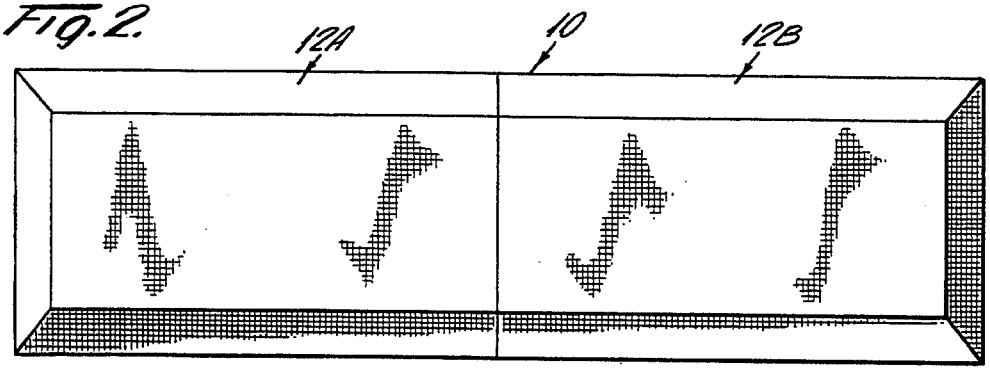
FIG. 2 is a top plan view of the casket of FIG. 1.
Figure 1:
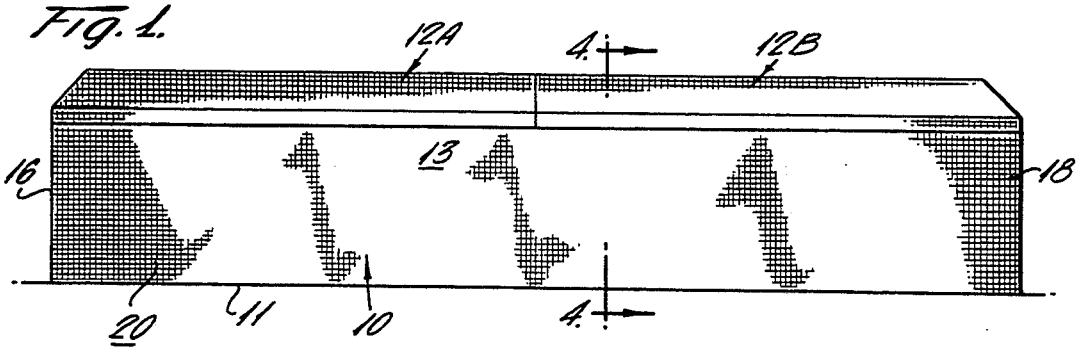
FIG. 1 is a side elevational view of a casket fabricated and assembled in accordance with a preferred embodiment of the invention.
Figure 3:
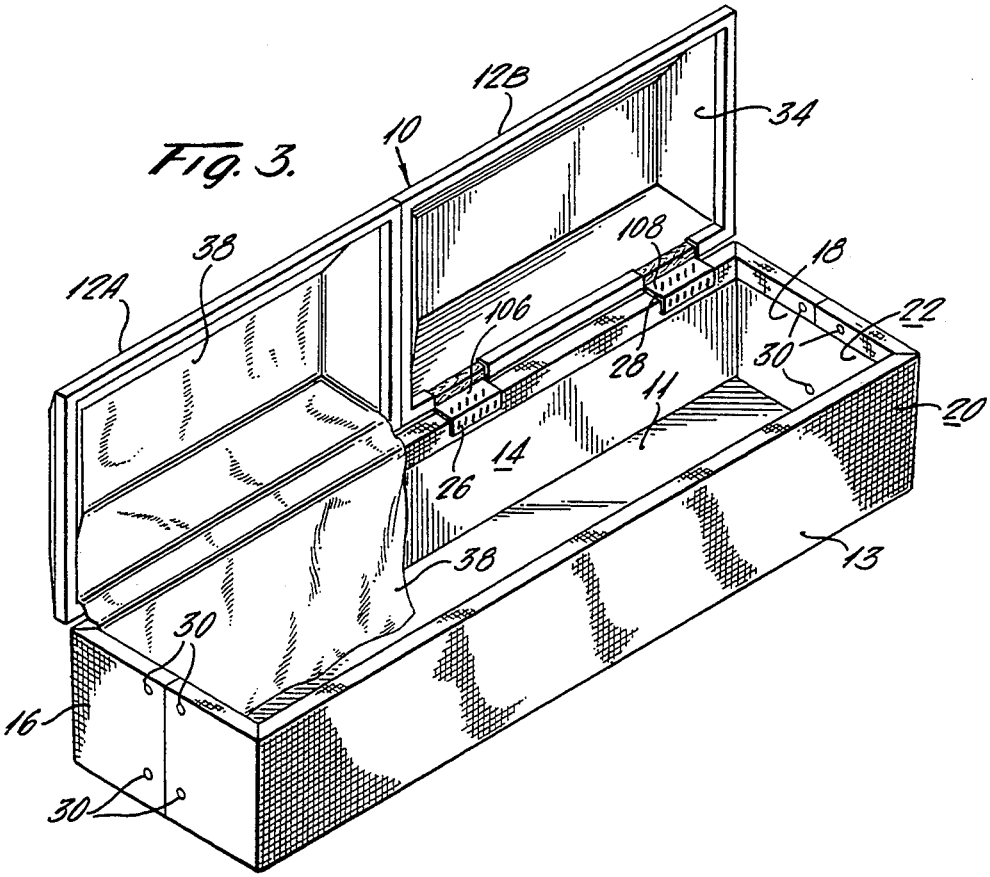
FIG. 3 is an isometric view of the casket of FIGS. 1 and 2, with the split lid open.

Referring now to the preferred embodiment of the invention shown in the drawings by way of example only and without thereby limiting the scope of the invention, FIGS. 1–3 shows the exterior of a completed casket body 10, plus a casket split lid 12A, 12B, constructed in accordance with a preferred embodiment of the invention. The corrugated fiberboard casket body 10 has a bottom 11, folded-up side walls 13 and 14 and closed ends 16 and 18 which are formed by folding up bottom end flaps and side end flaps, as will be described. The exterior of the casket body is covered with a pliable decorative covering 20 that is hand slit to permit the folding of the casket body, and the interior of the casket body is lined with a liquid-impervious fabric liner 22. Each half of the split lid 12A 12B is made of covered corrugated fiberboard and is hinged to the top of one sidewall 14 of the casket body, as by stapled fabric hinges 26 and 28, and the end flaps described later herein are held closed by manually-installed plastic rivets such as 30. Each of the lid sections in this example is provided with a snap-in insert such as 34 made of corrugated fiberboard, and the interior of at least the head-end lid section 12A is covered with a decorative fabric 38. The details of construction of the casket body and the manner of producing it will now be described.

FIG. 8 shows a corrugated fiberboard blank 40 from which the casket body is made. It is generally rectangular in shape, and is provided with two laterally spaced apart longitudinal score lines 41 and 42 along which the side portions or flaps 44 and 46 can readily be bent up to form the side walls 13 and 14 of the completed casket of FIG. 3. The left and right-hand halves of the blank are identical, hence only the right-hand side is described here in detail, corresponding parts of the left half being designated by corresponding numerals with the suffix A. Considering then the right-hand half of the blanks, a first transverse score line 50 extend laterally across the blank between score lines 41 and 42, and a pair of longitudinal end cuts 54, 56 are provided in alignment with the score lines 41 and 42 to permit easy bending up of the ends of the bottom to form bottom end flap 57. Transverse score lines 60, 62 respectively extend laterally between cuts 54, 56 and the edge of the blank, to facilitate the bending upward of the side end portions or flaps 66, 68. Score lines 60 and 62 are offset slightly toward the adjacent end of the blank, with respect to score line 50, so that, as described below, the side end flaps 66 and 68 can easily be folded inwardly toward each other, over bottom end flap 57, after the latter flap and the side flaps 44 and 46 have been folded upwardly. Further, shaped notches 70 and 72 are provided to accommodate the folding of side end flaps 66 and 68 at right angles to the side flaps 44 and 46, after the latter flaps have been folded up.

The blank is also preferably provided with two pairs of closely-spaced, parallel, longitudinal score lines 80, 82 and 84, 86, near the edges of the blank, which permit the blank to be folded inwardly twice at each edge to facilitate wrapping of the blank edges over and around the framing members 88 and 90, respectively, each of which framing strips is secured along a different one of the two opposite longitudinal edges of the blank, as shown in FIG. 10; the framing members may be secured to the fiberboard by a suitable adhesive, and extend only between the transverse score lines 60 and 60A.

However, if the blank is made narrower so as to fold over the top of the framing members but not along the inner sides thereof, only one such edge score line is needed, and if the blank is made still narrower so that it covers only the outer side of the framing members, neither of the edge score lines is needed.

Figure 11:
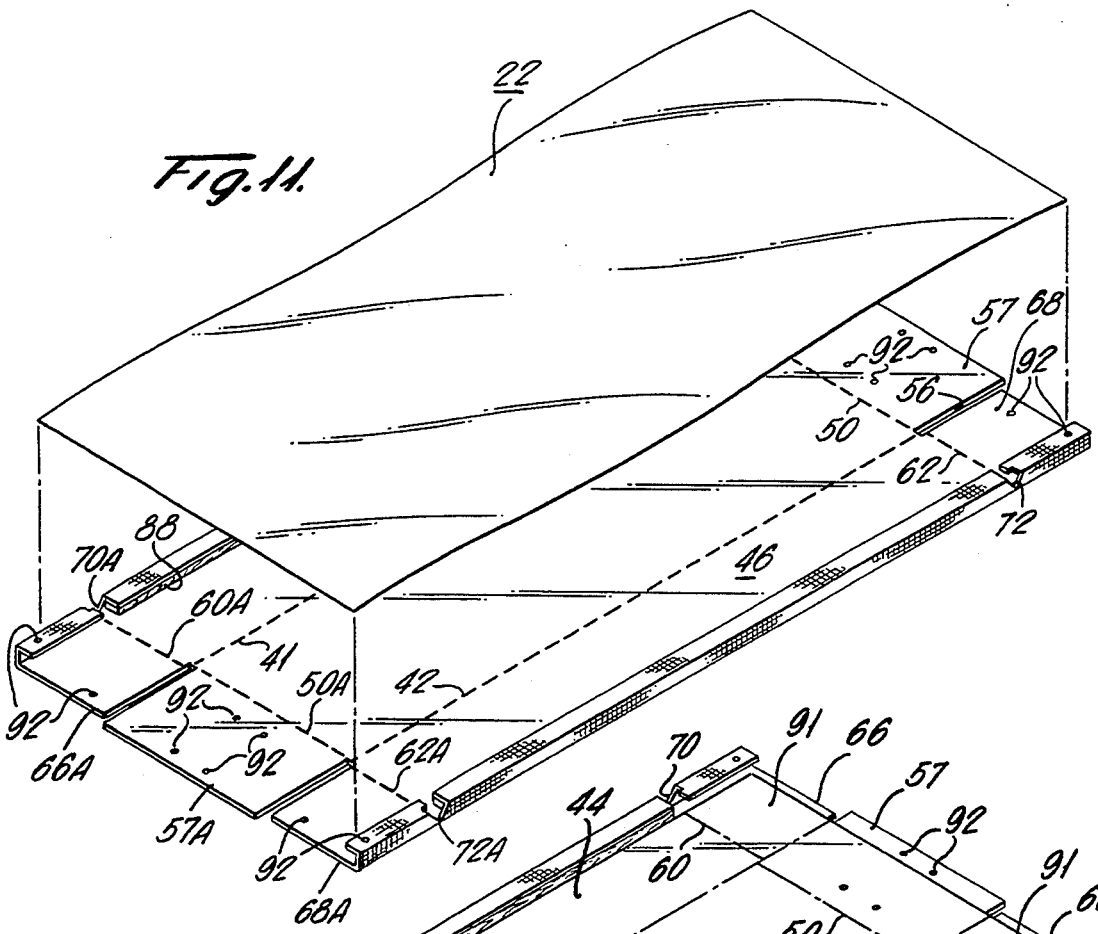
FIG. 11 is an isometric view similar to FIG. 10, but with both framing members in place, with the decorative covering adhered to the blank and to the framing strips and appropriately folded at its ends, and with a plastic liner positioned above the side of the blank opposite from the decorative covering about to be applied to that side.
Figure 12:
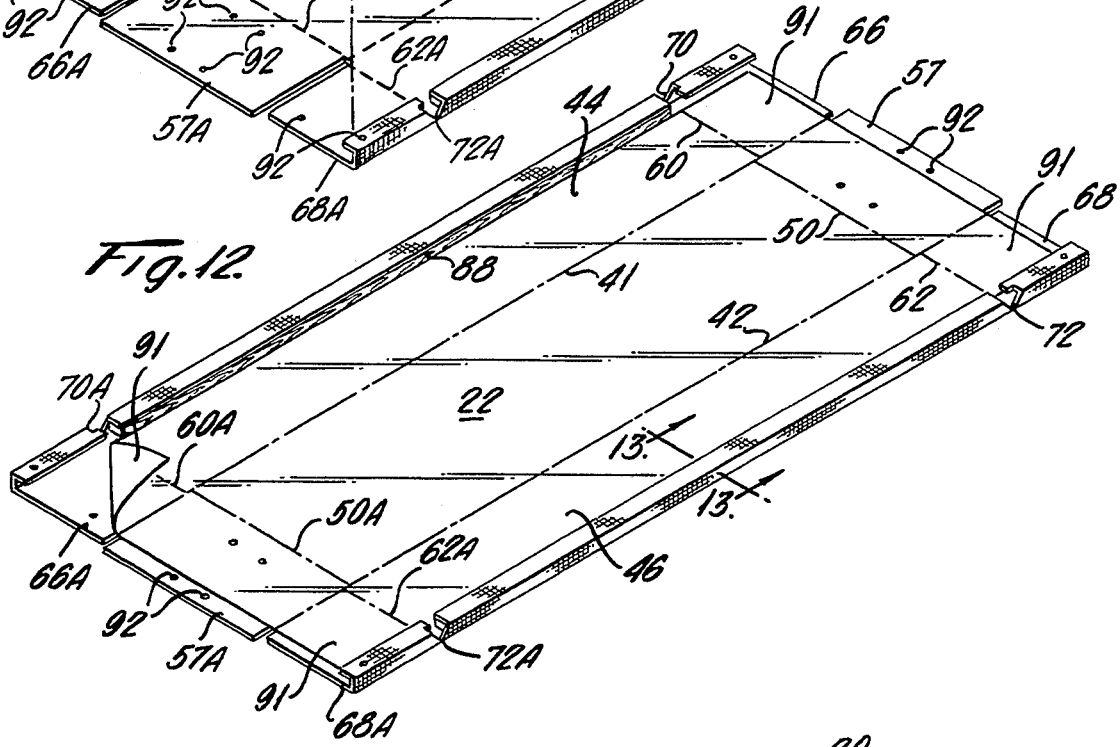
FIG. 12 is an isometric view like that of FIG. 11, but with the liner adhered to the blank, except at the corners where it is left loose.
Figure 14:
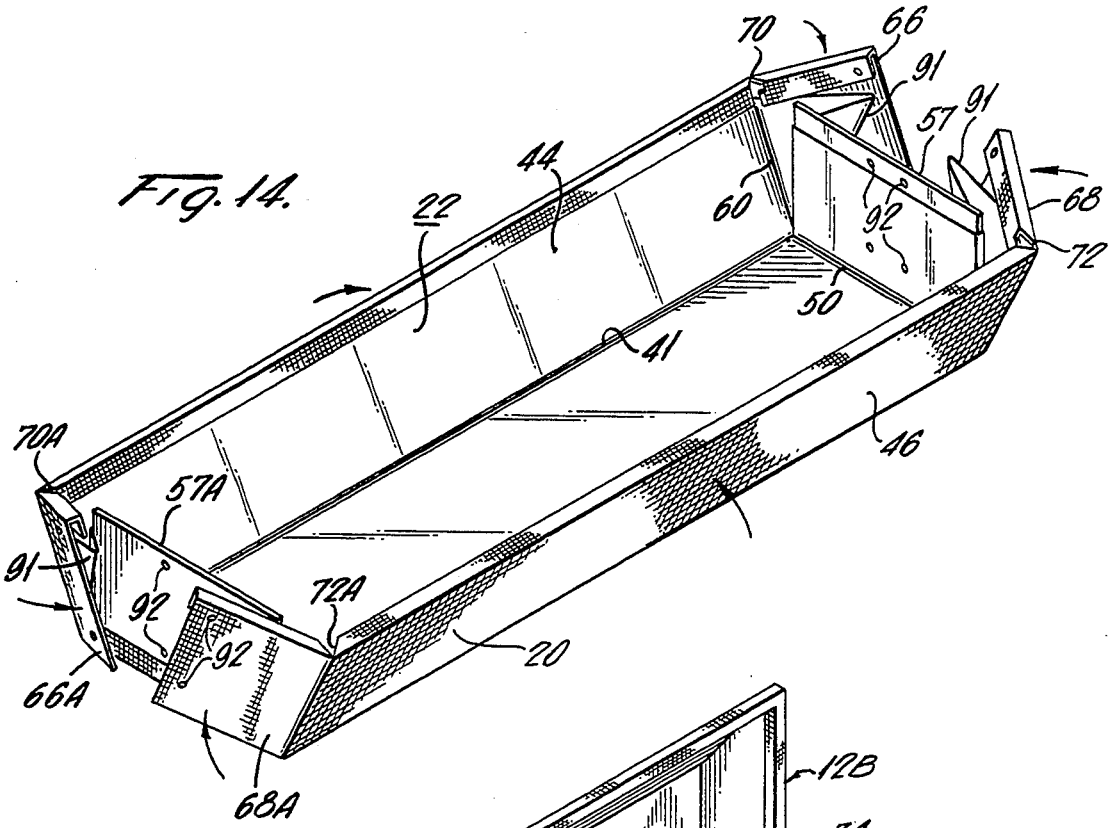
FIG. 14 is an isometric view of the blank, with decorative cover and liner, in the course of being folded up to form the casket body.

The rectangular piece of decorative fabric 20 (FIG. 10) is then secured to one face of the blank, and the fabric liner 22 is secured to the opposite face of the blank, as represented in FIGS. 11 and 12. The decorative covering is cemented to the blank throughout its entire surface including wrapping the appropriate edges of the blank and making the necessary hand cuts to facilitate folding of the blank. The liner is preferably cemented over most of its surface. However, a portion 91 of the liner at each corner is preferably left uncemented so that, as shown in FIG. 14, it can be tucked between the adjacent bottom end flap and side end flap during fold-up of the blank, to produce an attractive finish inside the casket body and at the same time assure that there is no possibility of fluid leakage from the interior of the casket body, to the exterior, at the corners.

In this preferred embodiment the blank including the decorative fabric 20 of a pliable material such as a cloth, a flexible non-woven synthetic such as organic polymer, or paper, extends entirely over the face of the blank which is to become the exterior of the casket body, and over what become the tops and inner sides of the framing strips when the blank is folded up to form the casket body (FIG. 13); however, as noted above, the fiberboard of the blank may if desired be sized so it covers only the outer sides of the framing strips, leaving the top and inner sides of the framing strips exposed. In this case the applied cover material would include extra length beyond the blank size to wrap around and cover the exposed framing wood.

Figure 4:
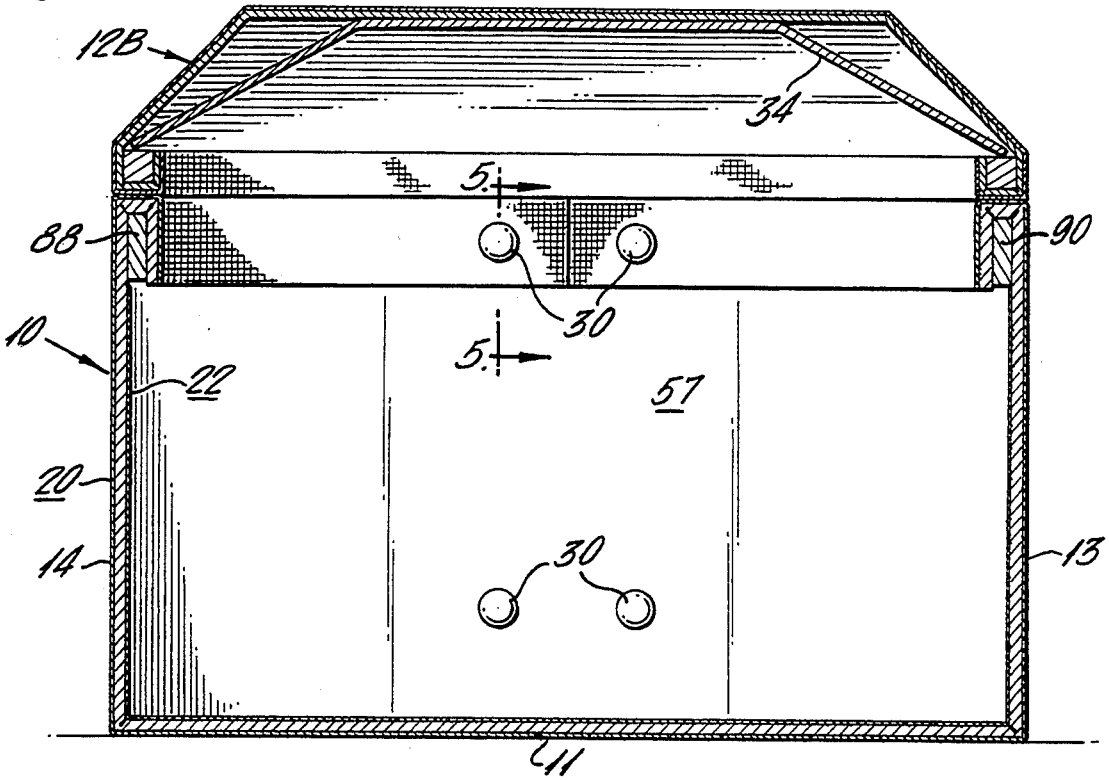
FIG. 4 is an enlarged sectional view taken along lines 4—4 of FIG. 1.
Figure 5:
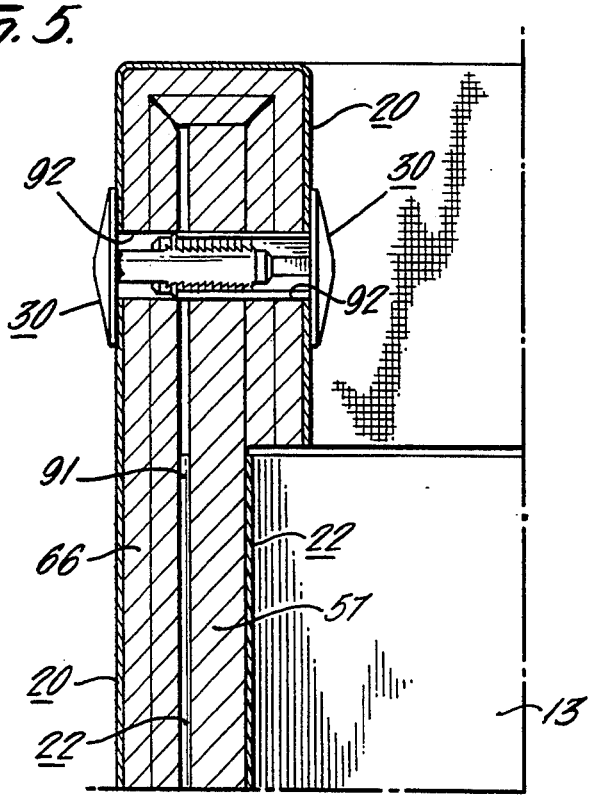
FIG. 5 is a further enlarged sectional view taken along line 5—5 of FIG. 4.
Figure 6:
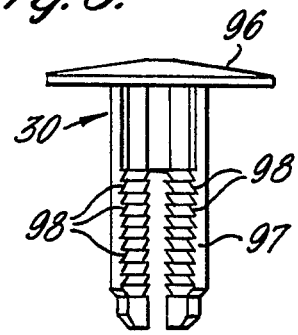
FIG. 6 is a side elevational view of the fastener preferably used in holding closed the ends of the casket body.
Figure 7:
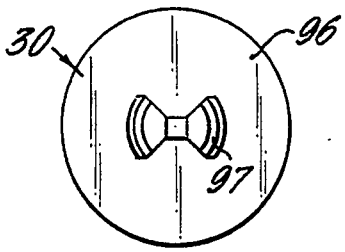
FIG. 7 is an end view of the fastener, looking into its tip.

Also provided in the blank are holes such as 92 extending through the side and bottom end flaps to receive the manually-insertable rivets 30 which hold them in position when completely folded up, as shown in FIGS. 4 and 5. The holes through the fiberboard for the rivets are preferably formed during original stamping and cutting of the blank; upon fold-up of the casket, one can feel the positions of the holes with a finger, and pierce the liner and exterior covering at the hole positions with any convenient simple instrument, such as an awl or sharp screwdriver. The user then need merely align the rivets with the corresponding holes, and press the two halves of the rivets into opposite sides of the hole. The two halves of the rivets are identical to each other, and are of a standard commercial type known as plastic ratchet rivets. Each comprises a cap 96 (FIG. 6) and a split shaft 97 carrying barbs 98 which slide over each other when the two halves are pressed together, but hold the halves against later separation. The rivets are preferably inserted where the rivet holes are shown in the drawings, some extending through a folded side end flap and a bottom flap near the bottom of the casket body and others extending through a folded side end flap and a bottom flap near their tops, where a side end flap extends over and about the top of the bottom end flap.

Figure 13:
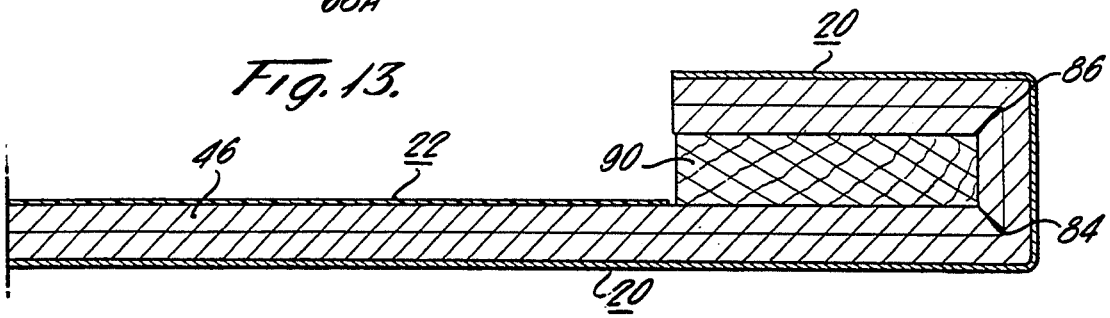
FIG. 13 is an enlarged fragmentary sectional view taken on lines 13—13 of FIG. 12.
Figure 15:
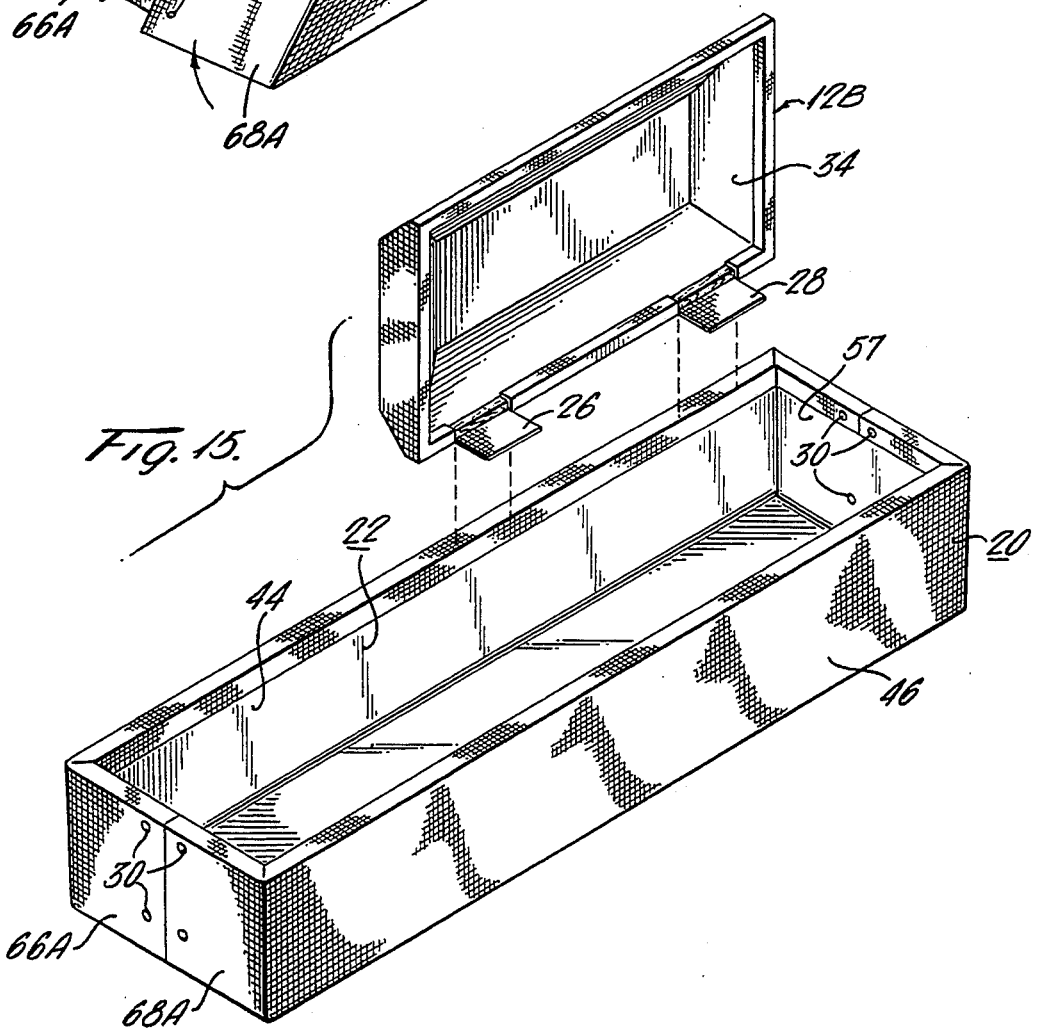
FIG. 15 is an isometric view of the casket body, fully folded up and assembled, with one half of the lid ready to be secured to the casket body by stapling of its fabric-and-fiberboard hinge to one of the framing strips of the body.

Referring now especially to the preferred overall fabrication process and the commercial use of the method and product, the blank 40 shown in FIG. 8 may be made by standard stamping, cutting and scoring techniques. The framing members 88 and 90 are glued in place, and the decorative covering 20 and the liner 22 then also glued in place, the corrugated fiberboard with the exterior decorative covering on it extending around what will become the tops and inner sides of the framing members when the blank is folded up, as shown in FIGS. 12 and 13. The completed flat casket body is shipped to a point of use, i.e. a location at which the casket body is to be formed. When a casket body is needed at that location, the flat blank assembly is folded up, as shown in FIG. 14, with the bottom end flaps inside the side end flaps and the covered fiberboard extending over the folded-up bottom flaps and side end flaps, as shown in FIG. 15. The triangular flaps of the liner at the corners are tucked between the side end flaps and the bottom end flaps as shown in FIG. 14. Preferably, hinges such as 26 and 28 that are included on the corrugated die cut lid for joining the lid sections 12A, 12B to the casket body are positioned on and are stapled to the top of one of the framing strips, as at 106 and 108 of FIG. 3, using only a standard stapler gun. The lid can be shipped separately or with the blanks.

There has therefore been provided a casket body precursor, a casket, and a method of providing same which enable convenient, inexpensive shipping of a flat unfolded casket body to a location where it is easily folded up and fastened together by hand, and to which a lid is easily secured, without requiring any special skills or complex or expensive tools.

The invention, in the preferred embodiment, uses corrugated fiberboard for the main casket structure, but other materials of suitable foldability, strength and rigidity may be used instead, if so desired.

While the invention has been described with particular reference to specific embodiments in the interest of complete definiteness, it will be understood that it may be embodied in a variety of forms diverse from those specifically shown and described, without departing from the spirit and scope of the invention.

What is claimed is:

1. A casket body precursor, comprising:

a flat blank of corrugated fiberboard having score lines permitting side portions thereof to be folded up to form a trough, and having end portions provided with score lines and cut lines permitting said end portions to be folded-up to form two opposite end walls; and a continuous, flexible and foldable cloth-like decorative covering completely covering to one face of said blank, whereby said blank can be folded up into a casket body, complete with decorative covering.

2. The casket body precursor of claim 1, comprising a pliable liquid-impervious liner substantially completely covering and secured to a face of said blank which is opposite said one face, whereby when said blank is folded to form said casket body, said body is completely lined with said liner.

3. The casket body precursor of claim 2, wherein corner portions of said liner are free of said blank, whereby upon subsequent folding up of the blank, triangular flaps of said liner are formed at each corner, for tucking within said end walls when said blank is folded up.

4. The casket body precursor of claim 1, comprising rigid framing members extending along, and secured to opposite side edges of said side portions of said blank.

5. The casket body precursor of claim 4, wherein said decorative covering extends over the exposed sides and tops of said framing members and covers all normally viewed edges of said casket body precursor.

6. The method of providing a casket body precursor, comprising:

forming a flat generally rectangular blank of corrugated fiberboard, cut and scored to permit folding the blank up to form a casket body having side and end portions, and securing to one face of said flat blank, prior to folding it up, a pliable decorative covering extending over said side and end portions of said blank.

7. The method of claim 6, comprising securing a liquid-impervious pliable liner to a face of said blank opposite from said one face and extending over said side and end portions of said blank which form the interior of said casket body when said blank is folded up.

8. The method of claim 6, comprising: prior to said folding up, securing strips of rigid material along the edges of said blank which are at the top of the sides of said casket body when said blank is folded up.

9. A casket precursor which can be folded up to form a casket, comprising:

(a) a flat blank of corrugated fiberboard having a first set of score lines along which side portions of said blank can be folded up as side flaps to form a casket trough, and having additional score lines and cuts at each end to form at each end a bottom end flap and a pair of side end flaps, all foldable to provide end closures for said trough;

(b) rigid framing members secured along the side edges of said blank; and (c) a continuous, flexible and foldable cloth-like decorative covering adhered to and extending completely over a face of said blank which forms the exterior of said casket when folded up.

10. The casket precursor of claim 9, in which each of said bottom end flaps is of a height and width to cover substantially completely the entire adjacent end of said trough when folded up, and Side end flaps of each of said pairs are of widths such that when folded toward each other they substantially cover the adjacent end of said trough.

11. The casket precursor of claim 10, wherein the width of each of said side end flaps is substantially equal to one-half the width of the adjacent end of said trough.

12. The precursor of claim 9, wherein said framing strips are secured to a face of said blank which when folded up becomes the inside of the casket.

13. The casket precursor of claim 12, wherein said covering extends over both sides and the top of said framing strips.

14. The casket precursor of claim 9, wherein said covering is a non-woven synthetic material or a paper material.

15. The method of providing a casket at a user site, comprising:

forming a flat rectangular blank of corrugated fiberboard with framing strips of rigid material secured along side edges of said blank, and a continuous, flexible and foldable cloth-like decorative covering secured to one face of said blank, said blank having a pair of longitudinal score lines permitting side portions of said covered blank to be folded upward to form a casket trough with said decorative covering on the exterior thereof and said blank having score lines and cuts at its ends to provide a pair of bottom flaps each foldable upwardly to close the adjacent ends of said trough, and to provide a pair of side end flaps at each end of said trough foldable toward each other to cover said folded bottom flaps;

transporting said flat blank with said covering thereon to an assembly site; and at said assembly site, folding up said side portions of said blank with said covering thereon to form a casket trough, folding up said bottom end flaps to close said end openings, folding inwardly toward each other said side end flaps with said covering thereon to form a closed casket with covering, and thereafter manually applying fasteners to said side end flaps and said bottom flaps to hold said flaps in their folded positions.

16. The method of claim 15, comprising securing a rectangular liquid-impervious sheet of liner material to a face of said blank opposite from said decorative covering, prior to said transporting step.

17. The method of claim 16, wherein said securing of said sheet of liner material comprises leaving a portion of said sheet near each of its corners free of said blank and, after said transporting step and during said folding of said bottom end flaps and said side end flaps, tucking said free portions of said liner material between said bottom end flaps and said side end flaps.

* * * * *